US008585108B2

(12) United States Patent
Karlsson

(10) Patent No.: US 8,585,108 B2
(45) Date of Patent: Nov. 19, 2013

(54) CONTAINER YOKE FOR LIFTING AND CENTERING OF CONTAINERS

(75) Inventor: Gösta Karlsson, Killeberg (SE)

(73) Assignee: ELME Spreader AB, Älmhult (SE)

( * ) Notice: Subject to any disclaimer, the term of this patent is extended or adjusted under 35 U.S.C. 154(b) by 0 days.

(21) Appl. No.: 13/393,819

(22) PCT Filed: Sep. 6, 2010

(86) PCT No.: PCT/SE2010/050945

§ 371 (c)(1),
(2), (4) Date: May 7, 2012

(87) PCT Pub. No.: WO2011/028172

PCT Pub. Date: Mar. 10, 2011

(65) Prior Publication Data

US 2012/0212004 A1 Aug. 23, 2012

(30) Foreign Application Priority Data

Sep. 4, 2009 (SE) ..... 0950636

(51) Int. Cl.
*B66C 1/00* (2006.01)

(52) U.S. Cl.
USPC ..... 294/81.53; 294/81.21

(58) Field of Classification Search
USPC ..... 294/81.53, 81.21, 81.1, 81.2, 81.4, 294/81.54
See application file for complete search history.

(56) References Cited

U.S. PATENT DOCUMENTS 5,280,980 A 1/1994 Coatta
6,312,213 B1 * 11/2001 Stinis ..... 414/803
(Continued)

FOREIGN PATENT DOCUMENTS

DE 19516520 A1 11/1996
JP 10-194657 A 7/1998
(Continued)

OTHER PUBLICATIONS

International Search Report and Written Opinion received for PCT Patent Application No. PCT/SE2010/050945, mailed on Dec. 20, 2010, 10 pages.
(Continued)

*Primary Examiner* — Saul Rodriguez
*Assistant Examiner* — Gabriela Puig
(74) *Attorney, Agent, or Firm* — Morrison & Foerster LLP

(57) ABSTRACT

A container yoke for simultaneous lifting of two containers placed in a row one after the other, i.e., containers that are placed with end portions facing each other, comprising a base frame coupled to a lifting device, for instance a crane or an industrial truck, outer cross beams arranged on the base frame and provided with outer lock members for engagement in, and locking of, the outer end portions of the two containers facing away from each other, essentially centered saddles arranged on the base frame and having lock members for engagement in, and locking of, the two containers at the end portions thereof facing each other. The invention is achieved by the fact that the saddles (10,11) of the container yoke are arranged to be floatingly and auto-seekingly movable laterally in relation to the base frame (4) of the container yoke, that members are arranged to automatically aim the locking members at, and bring them into engagement with, the corner boxes of the containers, and that members are arranged for the steering of the containers laterally in connection with the lifting of the same.

9 Claims, 10 Drawing Sheets

(56) References Cited

U.S. PATENT DOCUMENTS

| | | | | |
|---|---|---|---|---|
| 6,431,379 | B1 | 8/2002 | Kröll et al. | |
| 6,863,325 | B1 * | 3/2005 | Mills | 294/81.21 |
| 7,690,707 | B2 * | 4/2010 | Stinis et al. | 294/81.2 |
| 2004/0100111 | A1 * | 5/2004 | Stinis | 294/81.21 |
| 2005/0225104 | A1 * | 10/2005 | Lim et al. | 294/81.1 |
| 2009/0015025 | A1 * | 1/2009 | Karlsson | 294/81.4 |
| 2011/0155683 | A1 * | 6/2011 | Kim et al. | 212/307 |
| 2012/0306223 | A1 * | 12/2012 | Karlsson | 294/81.62 |

FOREIGN PATENT DOCUMENTS

| | | | |
|---|---|---|---|
| SE | 527325 | C2 | 2/2006 |
| WO | 2006/004531 | A1 | 1/2006 |

OTHER PUBLICATIONS

Extended European Search Report received for European Patent Application No. 10814033.6, mailed on Jun. 21, 2013, 7 pages.

* cited by examiner

CONTAINER YOKE FOR LIFTING AND CENTERING OF CONTAINERS

CROSS REFERENCE TO RELATED APPLICATIONS

This is a U.S. National Phase patent application of PCT/SE2010/050945, filed Sep. 6, 2010, which claims priority to Swedish Patent Application No. 0950636-1, filed Sep. 4, 2009, each of which is hereby incorporated by reference in the present disclosure in its entirety.

TECHNICAL FIELD

The present invention relates to container yokes intended for steering-in toward, locking to and lifting of containers. The invention particularly relates to container yokes of the twin-lift type for simultaneous lifting of two containers placed in a row one after the other, that is, with a respective short side or end portion facing each other. The invention especially relates to container yokes that during the lifting displace, preferably centre, the two containers in relation to each other.

BACKGROUND ART

A major part of all goods transports in the world today take place by means of containers. Containers are usually handled by different types of lifting devices in the form of industrial trucks and cranes, etc. With the purpose of rationalizing and speeding up the handling of a growing number of containers, there are today lifting yokes intended for, for instance, cranes and that can handle more than one container simultaneously. An example of this is the so-called twin-lift yokes that simultaneously manage to grip and couple two containers that are placed one after the other, i.e., containers that are placed with a respective end portion facing each other, and lift them both in a single lifting step. By lifting two containers simultaneously, valuable handling time is gained and in addition the containers will be exactly placed in relation to each other when putting them down.

If two containers to be lifted happen to stand somehow displaced in relation to each other, which easily may happen, e.g., if they are standing on an uneven substratum and thereby are standing somewhat rotated around the centre axis thereof in relation to each other, or if they are standing at a certain angle in relation to each other, difficulties arise to grip and lock them by the lifting yokes found today. The containers cannot then be lifted directly but the crane operator has to manually direct the different locking devices of the lifting yoke over the corner boxes of the containers where the locking and lifting devices are placed. This requires great concentration from the driver and requires extra time, which lowers the productivity.

Lifting yokes that can lift double containers are per se previously known.

SE527325 discloses, for instance, a container yoke intended to lift two containers placed one after the other, where at least one pair of locking devices or saddles, which are placed at the centre portion of the yoke and intended to grip into and couple/lock in the locking members placed at the short sides of the containers facing each other, are laterally displaceably arranged in relation to the base frame of the container yoke. However, these saddles have to, by the crane operator, be manually steered in over the corner boxes of the containers by means of, for instance, hydraulic control systems, which requires fine maneuvering and great skills of the crane operator and is time-consuming.

Prior art within this area does accordingly not solve the problem of, in a fast, simple and automatic way, reliably gripping, locking and lifting two containers, placed one after the other, that happens to be placed rotated or displaced in relation to each other and then automatically centring the containers during the lifting as well as putting them down in a corrected and optimal way in relation to each other.

SUMMARY OF THE INVENTION

An object of the invention is to solve the problems mentioned above and to suggest a container yoke, of the kind mentioned by way of introduction, which in a fast, simple and auto-seeking way reliably directs itself and grips, locks and lifts at least two containers, placed one after the other, even if they are placed rotated or displaced in relation to each other, and to automatically centre the containers in relation to each other during the lifting so that they are put down in a corrected way.

An additional object of the invention is that the saddles and/or lock members of the container yoke should be freely movable or floating so that the alignment of the lock members of the container yoke to the corner boxes of the respective container should be effectable without manual fine maneuvering by the driver.

Yet an object of the invention is that the last alignment of the container yoke and the lock members thereof to at least some of the corner boxes of the containers takes place automatically.

An additional object of the invention is that the centring of the two containers takes place in a mechanical way.

Yet an object of the invention is that the mechanical centring takes place by means of hydraulics.

Said and additional objects and advantages are achieved according to the invention by a device according to the features indicated in the characterizing clause of claim 1.

Accordingly, the invention relates to a container yoke of the twin-lift type that, without accurate fine maneuvering or detailed control by the driver, during the final phase of the alignment toward, the gripping of and the locking to two containers, directs the lock members of the saddles to the corner boxes of the two containers by means of mechanical search levers. This implies that at least one pair of the locking members can be set in a "floating" state, i.e., in a state where they can move, or swing, freely laterally at least within a limited area. The locking members at the outer transverse beams of the container yoke first engage with the corner boxes placed at the end wall portions or short sides of the containers facing away from each other and the container yoke in its entirety is thereby directed over the two containers. Next, the centred lock members of the container yoke are lowered somewhat so that they engage with the corner boxes of the containers placed at the end wall portions or short sides facing each other. All lock members are brought to lock on one and the same occasion or in another suitable order. Next, the two containers are lifted in a single common lifting step, and during the lifting, the container yoke centres the two containers in relation to each other so that they in the subsequent putting down of the containers onto a substratum, or onto other containers, are placed centred and correctly aligned with each other. Consequently, in the coupling phase, the container yoke and the saddles are freely floating and auto-seeking and, without help, automatically steer in the saddles and lock members of the container yoke in the horizontal direction toward the corner boxes of the containers. In this way, the steering-in step of the container yoke is speeded up and the lifting and handling of containers is rendered more effective, which makes the handling more cost-effective. By the telescopic construction thereof, the container yoke can lift containers of different lengths and can also be arranged to be able to lift a single container.

Additional features and advantages of the invention are seen in the following, more detailed, description of the invention as well as in the appended drawings and additional claims.

BRIEF LIST OF DRAWINGS

The invention is described in more detail below in some preferred embodiment examples, with the aid of the appended drawings.

Figure 12:
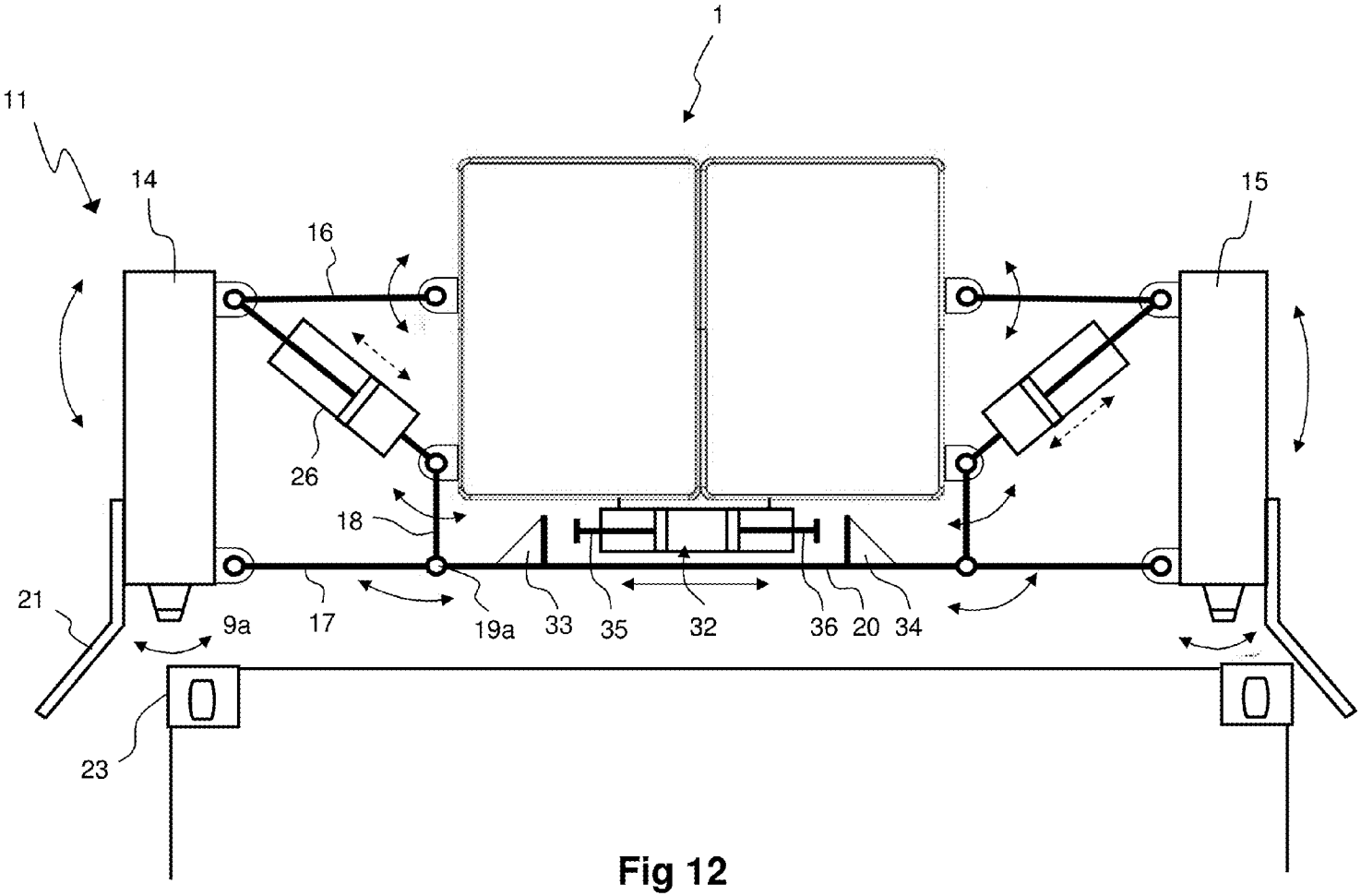

FIG. 12 principally shows an alternative embodiment of the invention with a saddle in its floating state having only one double cylinder arranged for the centring function.

DESCRIPTION OF PREFERRED EMBODIMENTS

Accordingly, the present invention relates to a container yoke of the twin-lift type intended to be able to lift two containers placed one after the other simultaneously and, without the detailed control or fine maneuvering of the driver, laterally automatically direct the centred saddles and their lock members toward the corner boxes placed at the end wall portions of the two containers facing each other.

Figure 1:
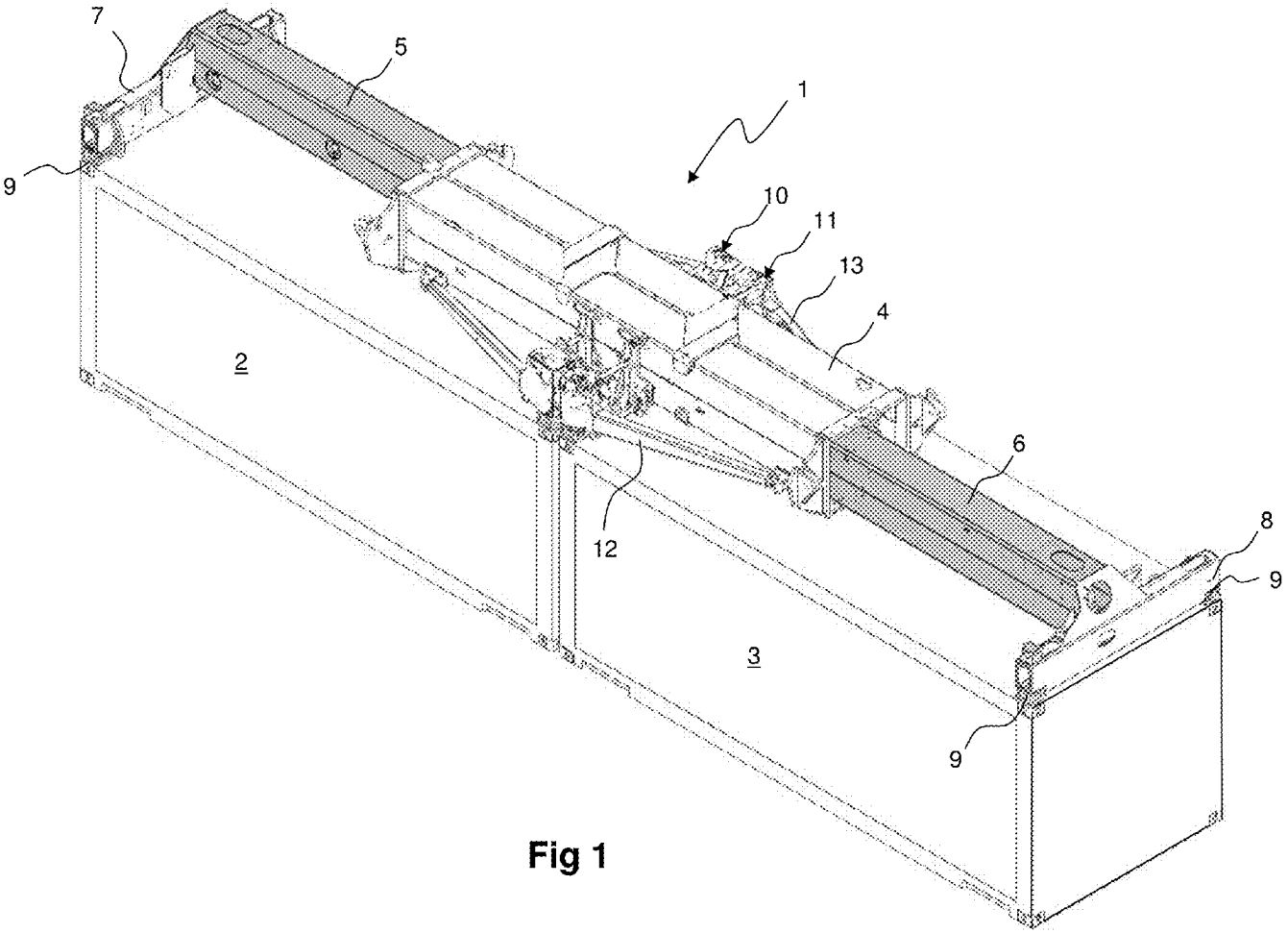
FIG. 1 shows a side view of a container yoke according to the invention, which has engaged with and lifts two containers placed one after the other.

FIG. 1 shows how a lifting yoke 1 according to the invention has gripped, coupled and locked to two containers 2,3 placed in a row one after the other. The container yoke 1 consists of a base frame 4 in which two beams 5,6 are displaceably arranged. At the outer ends of the beams 5,6, cross beams 7,8 are arranged, which, at the outermost ends thereof, are provided with lock members 9, so-called twistlocks. At the centre portion of the base frame 4, two so-called saddles 10,11 are arranged. Each saddle 10,11 consists of two twinlift boxes 14,15 (see FIG. 6) that are coupled and articulately mounted to each other and to the base frame 4 by means of a link lever system. Link levers 12,13 allow the saddles 10,11 to move to a limited extent, or be angled, laterally, i.e., transverse to the imaginary longitudinal axis of the base frame 4. The locking members 9 placed in the twinlift boxes 14,15 can, to a limited extent, also be raised and lowered in the vertical direction in relation to the base frame 4. The containers 2,3 are shown in the figure during a lift and are here centred in relation to each other. The connections to a crane or another suitable lifting device have been omitted in the figure for the sake of clarity.

Figure 4:
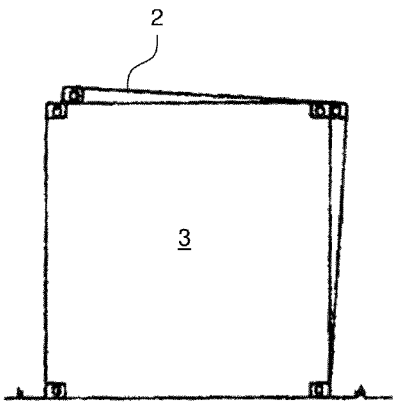
FIG. 4 shows two containers from an end portion and that are standing somewhat rotated in relation to each other.
Figure 3:
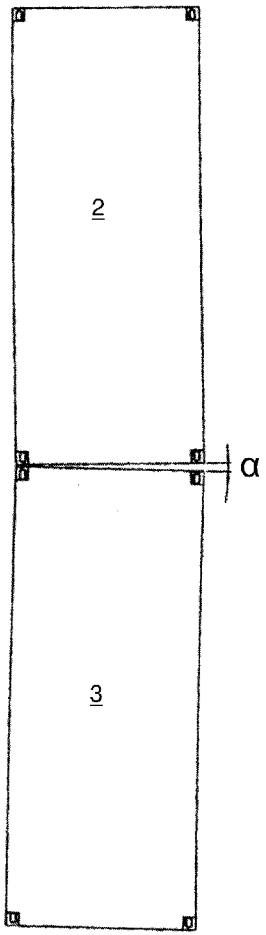
FIG. 3 shows two containers from above that are standing somewhat angled in relation to each other.
Figure 2:
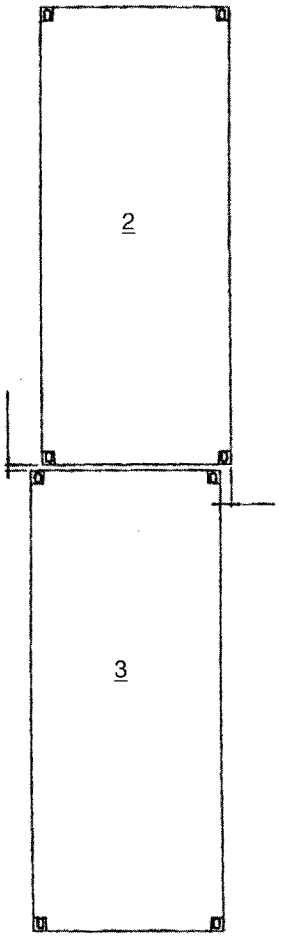
FIG. 2 shows two containers from above and shows how the containers are standing laterally displaced in relation to each other.

FIGS. 2-4 show different examples of how containers 2,3 may happen to stand placed in relation to each other and still be gripped, locked and centred by means of the present invention. In FIG. 2, it is shown from above, e.g., how two containers 2,3 are standing laterally displaced in relation to each other. In FIG. 3, it is shown from above how the containers 2,3 are placed at an angular displacement a in relation to each other, and in FIG. 4, it is shown from the side how two containers 2,3 are standing rotated in relation to each other. In all cases, the containers 2,3, can, thanks to the floating and movable saddle construction, easily be gripped, lifted and centred by the container yoke 1 according to the invention.

Figure 5:
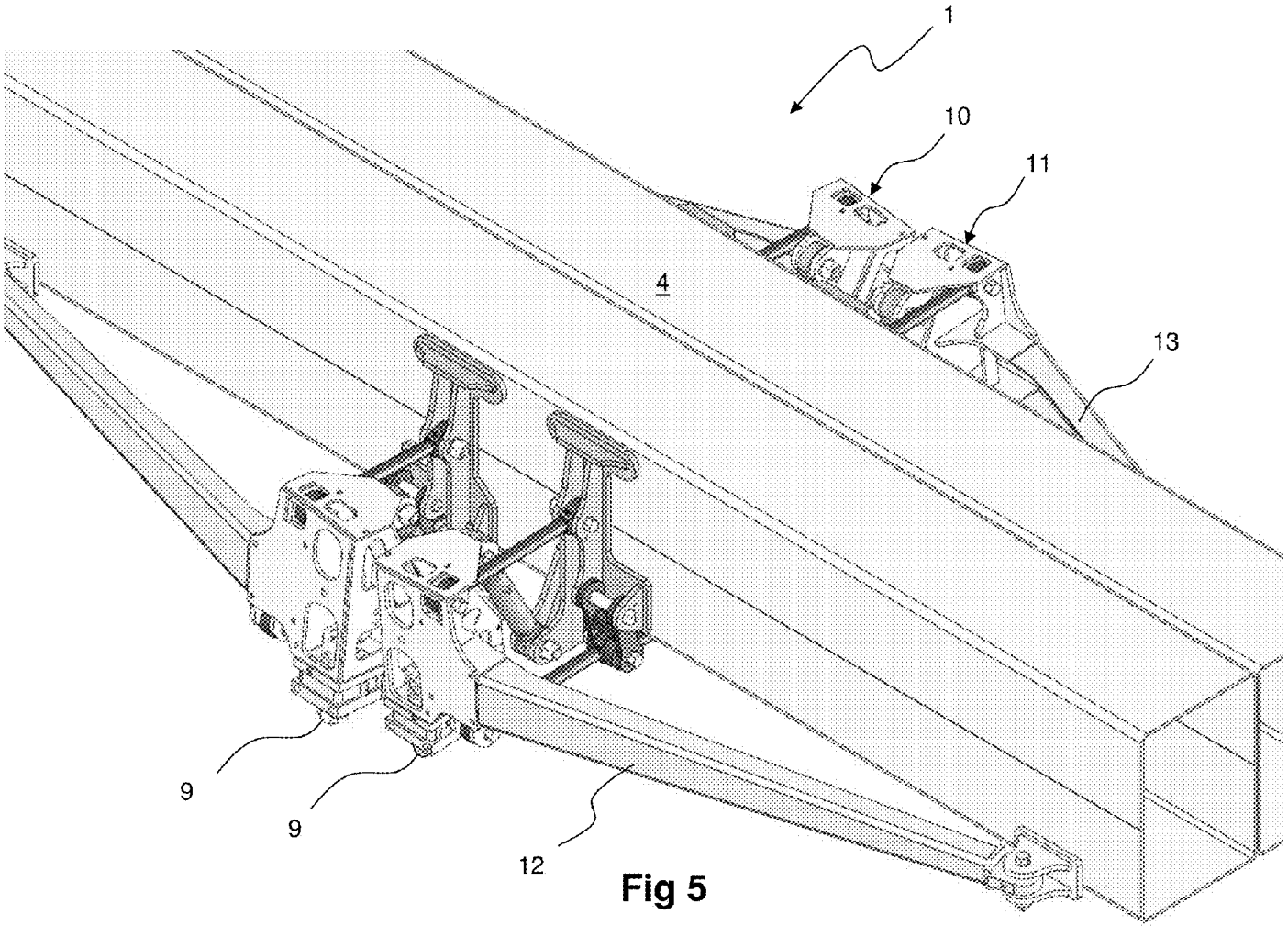
FIG. 5 shows in a view obliquely from above in more detail a container yoke according to the invention having two saddles, which by a respective link lever system are displaceable transverse to the longitudinal axis of the container yoke, i.e., laterally in relation to the longitudinal axis of the container yoke.

FIG. 5 shows in a view obliquely from above in more detail a container yoke 1 according to the invention having a base frame 4 and two saddles 10,11 placed one after the other in the longitudinal direction of the container yoke 1, and that, by the suspension thereof in link levers 12,13, are displaceable and/or angleable laterally transverse to the longitudinal axis of the container yoke 1. In the figure, it is shown how the saddles 10,11, and the lock members 9 thereof, are somewhat laterally displaced in relation to each other.

Figure 6:
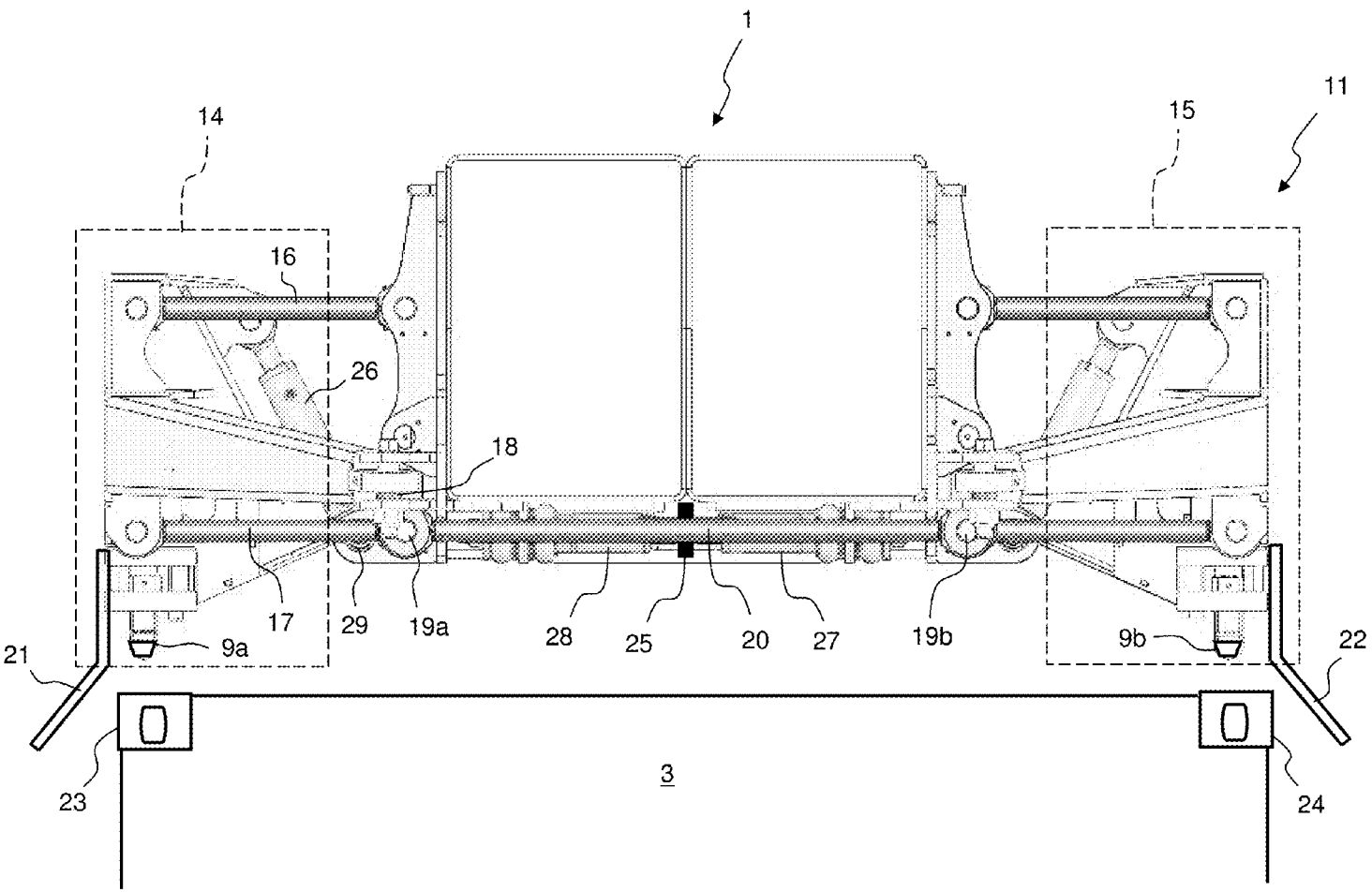
FIG. 6 shows more in detail in a cross-section through the base frame of the container yoke the components and link levers that are included in one of the saddles.

FIG. 6 shows, in a cross-section through the base frame 4 of the container yoke 1, more in detail the components and link levers that are included in one of the saddles 11. The locking members 9 are arranged in so-called twinlift boxes 14,15, which are suspended in a respective system of parallel levers wherein an upper link lever 16 attaches the upper part of the twinlift box 14 to the base frame of the container yoke 4 while a lower link lever 17 attaches the lower part of the twinlift box 14 to one end of a vertical link lever 18 in a fulcrum 19*a* and that at the other end thereof is articulately fixed in the base frame 4 (see also FIGS. 11 and 12). To the fulcrum 19*a* between the lower link lever 17 and the vertical link lever 18, there is also coupled one end of a horizontal stay 20 arranged transverse to, and preferably placed under, the base frame 4. The horizontal stay 20 is, at the other end thereof, coupled to the corresponding fulcrum 19*b* in the other twinlift box 15 placed on the other side of the base frame 4. This entails that both twinlift boxes 14,15 are mechanically coupled to each other, which provides a constant distance between the twinlift boxes 14,15 and the locking members 9*a*,*b* irrespective of the lateral position of the saddle 10,11 in relation to the base frame 4.

The twinlift boxes 14,15 are provided with a respective searching lever 21,22, which makes that, when the twinlift boxes 14,15 and the locking members 9*a*,*b* are lowered and not immediately hit the corner box 23,24 of a container 2,3, at least one of the searching levers 21,22 will still always hit a corner or edge of the container 2,3. Thereby, the searching lever 21,22 causes a pulling or pushing force on the nearest twinlift box 14,15, thereby displacing and/or angling the saddle 10,11 laterally outward and away from the base frame 4 of the container yoke 1, so that the locking members 9*a,b*, e.g. by means of cylinders 26, can be lowered into the lock openings of the corner boxes 23,24 and lock the container 3. Simultaneously, the horizontal stay 20 then pulls and/or angles the other twinlift box 14,15 inward toward the base frame 4. In this way, the twinlift boxes 14,15 perform in practice a pendulum motion and the locking members 9 are parallel-moved laterally.

In order to allow that two containers 2,3 are centred in relation to each other during a lift, and that the twinlift boxes 14,15 and/or the locking members 9*a,b* should be movable or be angled laterally, during the alignment and coupling phase, the lower horizontal transverse stay 20 is provided with a fixed holder-on 25 arranged preferably in the middle of the stay 20. On each side of this holder-on 25, two actuators are arranged in the form of hydraulic cylinders 27,28 having piston rods (see FIG. 11) that are mounted in the base frame 4 of the container yoke 1. The outer ends of the piston rods of the cylinders 27,28 are not fixedly coupled, neither to the base frame 4 nor to the stay 20, but when the piston rods are pushed out of the cylinders 27,28 they engage against and presses against said holder-on 25 and thereby displace the horizontal transverse stay 20 and by that the twinlift boxes 14,15 to an centre or vertical position, i.e., a centred position of the saddles 10,11 and/or locking members 9 in relation to the base frame 4. When the saddle 10,11 and the twinlift boxes 14,15 need to be floating, e.g. before alignment, gripping and locking of the container yoke 1 to containers 2,3, the piston rods are retracted in the cylinders 27,28, which gives room for the lateral swinging and/or angulation of the saddles 10,11 in relation to the longitudinal axis of the base frame 4. When the containers 2,3 are raised, the two piston rods are pressed out of the cylinders 27,28 toward the holder-on 25 wherein the horizontal transverse stay 20, and thereby the saddles 10,11 and the lock members 9 thereof, will be centred to said centre or vertical position wherein the two containers 2,3 also will be centred aligned with each other. It is naturally possible, if it would prove advantageous, that the piston rods are pressed out differently much to provide a lateral movement of the containers in another way than with the purpose of centring them.

The cylinder 26 is arranged between the upper part of the twinlift boxes 14,15 and a lower point of attachment 29 at the base frame 4, by which cylinder 26 lifting and lowering of the twinlift boxes 14,15 and the locking members 9 can be provided. In this way, the container yoke 1 can first grip and lock to the containers 2,3 at the outer end portions thereof facing away from each other, and not until then to the end portions of the containers 2,3 facing each other.

Figure 7:
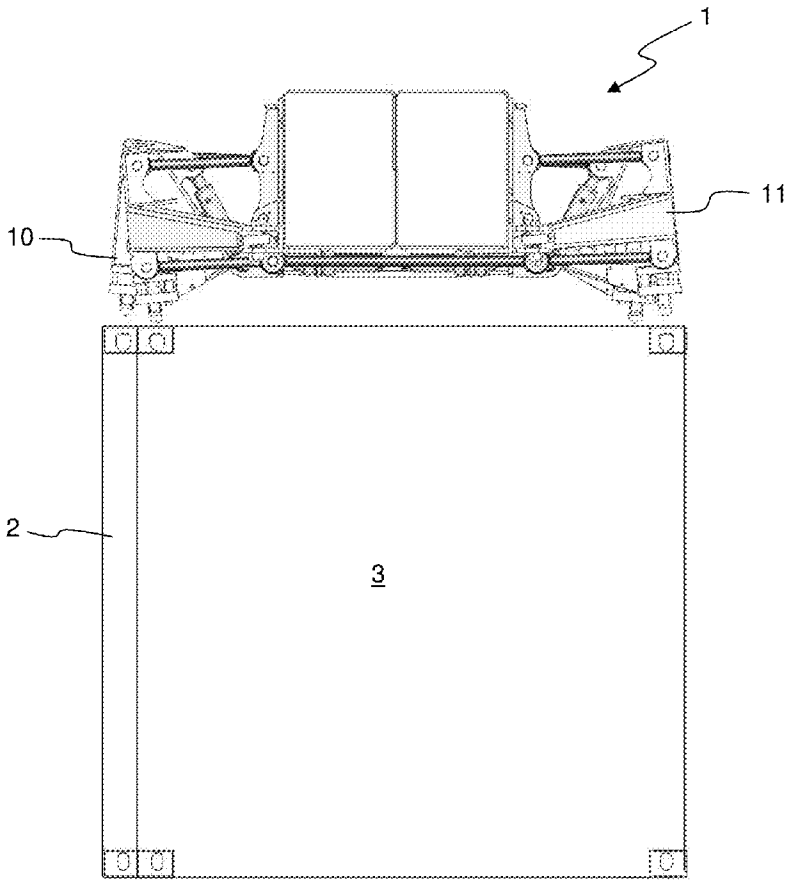
FIG. 7 shows the container yoke gripping two containers placed one after the other, from the end portions of one of the containers, wherein it is seen how the two saddles have been laterally displaced in relation to each other to be coupleable to the two containers simultaneously.

FIG. 7 shows in a view the container yoke 1 gripping two containers 2,3 placed one after the other, as seen from the end portions of the containers 2,3, wherein it is seen how the saddles 10,11 and/or the locking members 9 have been displaced or angled laterally in relation to each other to be coupleable to the two containers 2,3 simultaneously. Here, the outer coupling parts of the container yoke 1 are removed for the sake of clarity.

Figure 8:
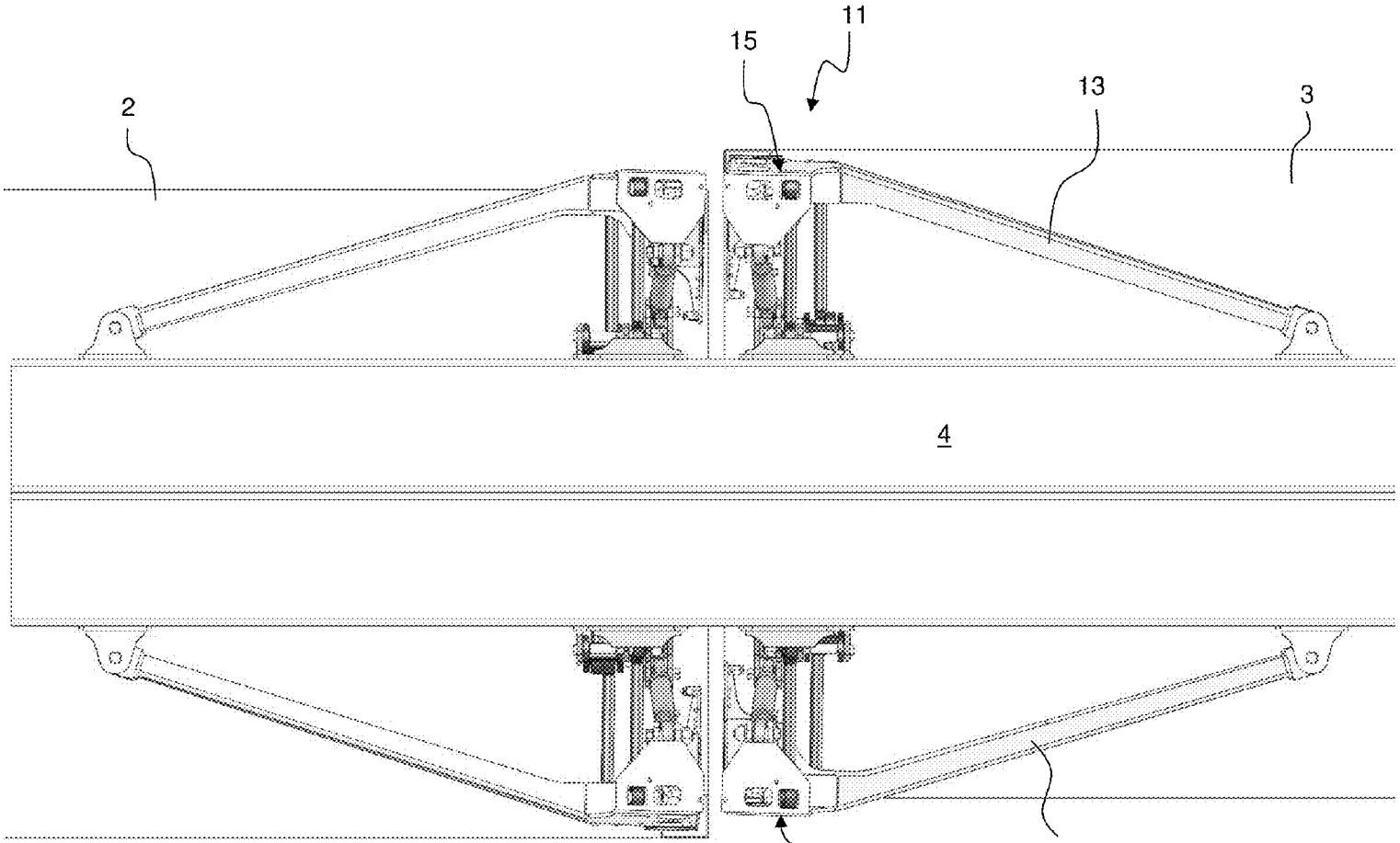
FIG. 8 shows the same position as FIG. 7 but from above.

FIG. 8 shows the same position of the saddles 10,11 as in FIG. 7, but from above. Here, it is also seen how the containers 2,3 are standing displaced and/or angled laterally in relation to each other and how outer stays 12,13 are articulately arranged between the base frame 4 and the twinlift box 14,15 of the respective saddle 10,11 to allow lateral movement and/or angulation of the saddle 11.

Figure 9:
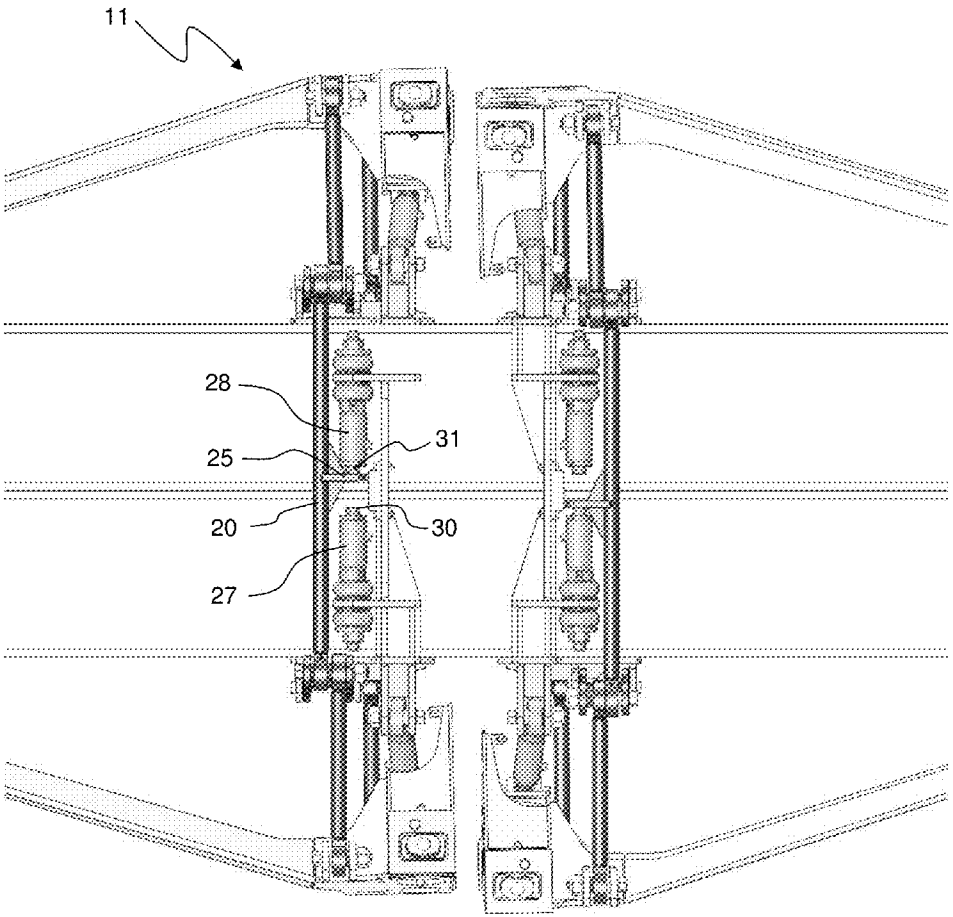
FIG. 9 shows the same position as FIGS. 7 and 8 but from below.

FIG. 9 shows the same position as FIGS. 7 and 8, but from below. Here, the two saddles 10,11 and the placement of their lower link levers and cylinders are seen. The placement of the components shows how the saddles 10,11 have reached and assumed and a respective lateral end position and accordingly the saddles 10,11 are here maximally displaced and/or angled in relation to each other. When the cylinders 27,28 are supplied with hydraulic oil under pressure, the piston rods 30,31 will press against the holder-on 25 of the intermediate stay 20 and thereby act on the saddles 10,11 to assume a centred and vertical position in relation to the base frame 4.

Figure 10:
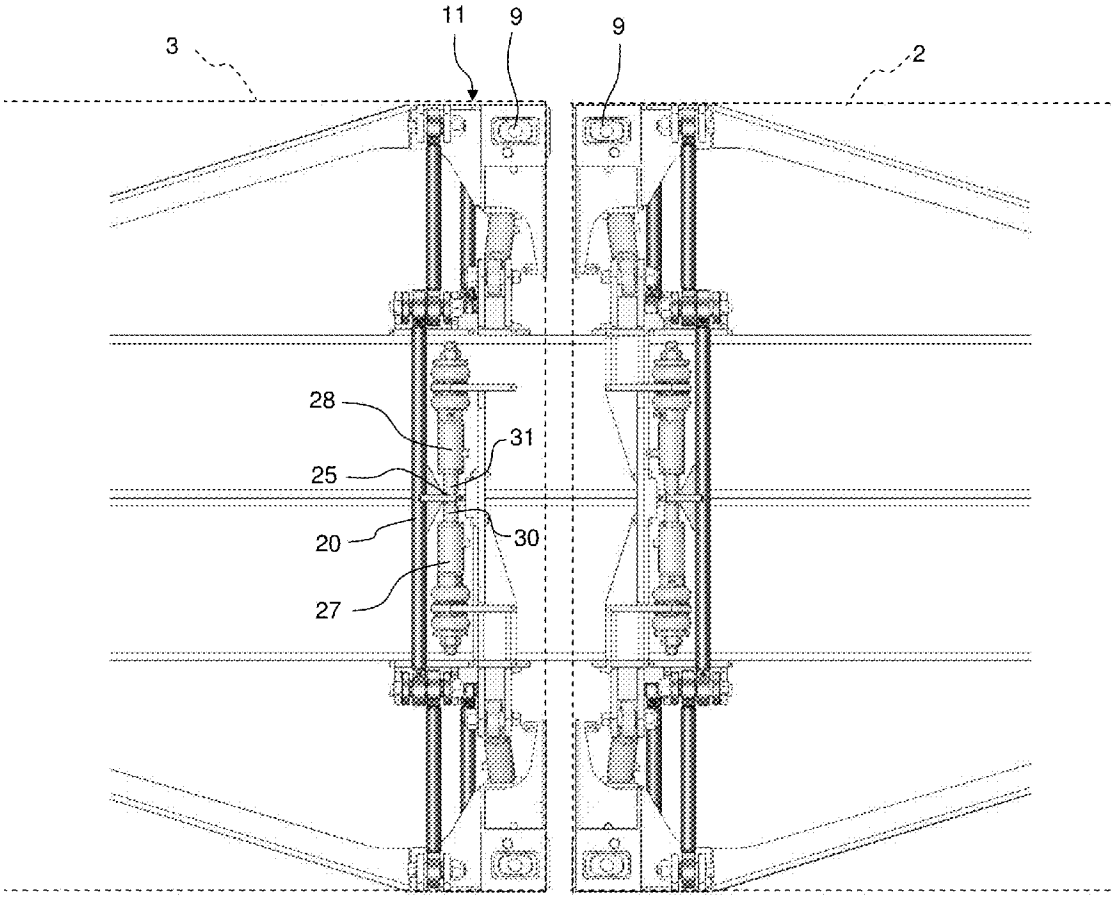
FIG. 10 shows from below how the container yoke, after the lifting, has centred the two containers in relation to each other.

FIG. 10 shows how the container yoke 1, after initiated lifting, has centred the two containers in relation to each other. The cylinders 27,28 have here been supplied with hydraulic oil and the piston rods 30,31 have been pushed out to an outer position and press on both sides of the holder-on 25 of the intermediate stay 20, thereby pressing the saddles 10,11 and the locking members 9 into a centred position.

Figure 11:
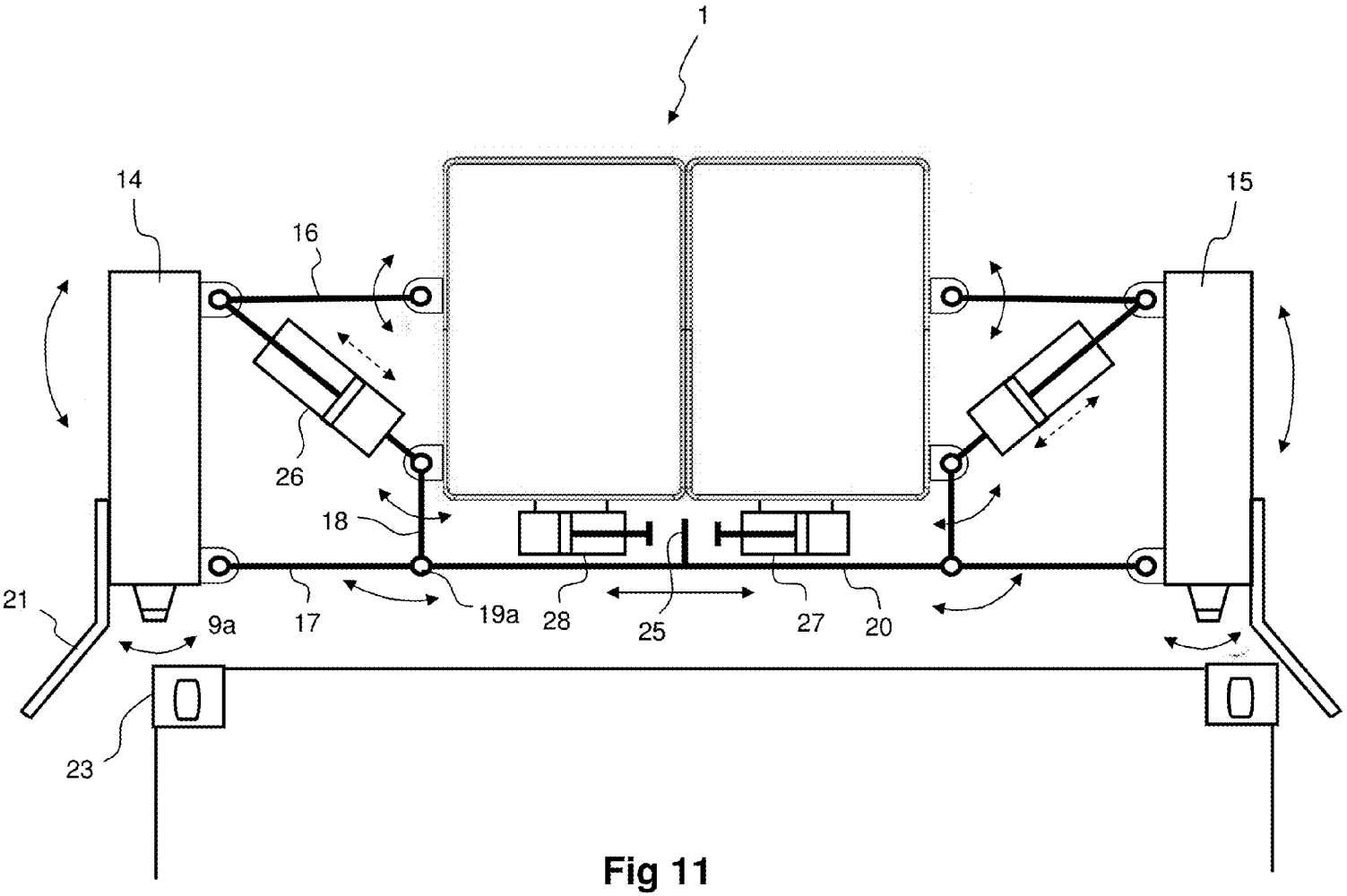
FIG. 11 shows more clearly the principle of the present invention and more precisely a saddle in its floating state having two cylinders arranged for the centring function.

FIG. 11 shows more clearly the principle of the present invention. Here, the saddle 10 is shown in its floating state having two cylinders 27,28 for the centring function. Arrows indicate how link levers and stays can turn around the joints and fixing points thereof.

FIG. 12 shows principally an alternative embodiment of the invention. The difference compared to FIG. 11 is that the saddle 11 in its floating state has only a single actuator, a hydraulic double cylinder 32, arranged for the centring function. Here, the lower horizontal transverse stay 20 is provided with two fixed holder-ons 33,34. The hydraulic cylinder 32 is mounted against the base frame 4 of the container yoke 1. The cylinder 32 is double-acting and has a piston rod 35,36 directed in each direction. These two piston rods 35,36 can engage with and press against said holder-ons 33,34. When the twinlift boxes 14,15 need to be floating, the piston rods 35,36 are entirely or partly retracted in the cylinder 32, which gives room for the lateral swinging and/or angulation of the saddle 11 in relation to the longitudinal axis of the base frame 4. When the containers 2,3 are raised, the two piston rods 35,36 are brought to project out of the cylinder 32 toward the respective holder-on 33,34 wherein the horizontal transverse stay 20 will be centred to an centre or vertical position and the two containers 2,3 will be centred aligned with each other.

The function of the container yoke when gripping containers 2,3 that are standing displaced, with angular displacement or rotated in relation to each other, is accordingly that one or both saddles 10,11 and the locking members 9 arranged therein are displaced and/or angled in relation to each other and/or in relation to the container yoke 1 and in a direction transverse to the longitudinal axis of the container yoke. The displacement and/or the angulation are principally accomplished mechanically by means of search levers 21,22 and the saddles 10,11 thus move freely during the steering-in.

The description above is primarily intended to facilitate the understanding of the invention. The invention is therefore naturally not limited to the embodiments mentioned but also other variants of the invention are possible and feasible within the scope of the general idea of the invention and the scope of protection of the subsequent claims. Thus, the hydraulic cylinders may, for instance, be exchanged for other types of actuation devices such as electric, pneumatic, magnetic or similar actuators. In practice, any actuators of a known type may be used. Instead of centring the containers in a lift, it is also naturally possible to use the technique according to the invention to steer the containers into a certain desired position in relation to each other. The centring or steering could also be achieved without the cylinders operating actively, i.e., the centring could be achieved by the containers by themselves turning into an centre position since they will strive toward an equilibrium position in the middle of the construction, alternatively that this function could be facilitated by, for instance, some resilient member.

The invention claimed is:

1. Container yoke (1) for simultaneous lifting of two containers (2,3) placed one after the other, comprising a base frame (4), outer cross beams (7,8) arranged on the base frame (4) and provided with lock members (9) for engagement in, and locking to, the outer end portions of the two containers (2,3) facing away from each other as well as at least two essentially centred saddles (10,11) arranged at the base frame (4) and provided with twinlift boxes (14,15) having additional lock members (9) for engagement in, and locking of, the two containers (2,3) at the end portions thereof facing each other, the lock members (9) of one of the saddles (10) locking one of the containers (2,3) and the lock members (9) of the other saddle (11) locking the other container (2,3), and that search levers (21,22) are arranged to aim the locking members (9) at, and bring them into engagement with, the corner boxes (23,24) of the containers, characterized in that the twinlift boxes (14,15) are coupled and articulately mounted to each other and to the base frame (4) by means of a system of parallel levers comprising a lower transverse stay (20) for the movement of the twinlift boxes (14,15) transverse to the longitudinal direction of the base frame (4), that the lower horizontal transverse stay (20) is provided with at least one fixed holder-on (25,33,34), that at least one actuator (27,28,32) in the base frame (4) is arranged to, during the steering-in phase, avoid mechanical contact with the lower horizontal transverse stay (20) and let the holder-on (25,33,34) and thereby the lower horizontal transverse stay (20) swing/float freely transverse to the longitudinal direction of the base frame (4), and that the actuator (27,28,32) is arranged to, during the lifting phase, engage mechanically with and press against said holder-on (25,33,34) in order to produce a mechanical movement of the lower horizontal transverse stay (20) and thereby the saddles (10,11) and the containers (2,3) into a desired position in relation to the base frame (4), for instance in order to attain a centering of the saddles (10,11) and the containers (2,3).

2. Container yoke according to claim 1, characterized in that the fixed holder-on (25) is arranged preferably in the middle of the lower horizontal transverse stay (20).

3. Container yoke according to claim 1, characterized in that two actuators (27,28) are placed in the base frame (4) of the container yoke arranged to, by the piston rods (30,31) thereof, press against the holder-on (25) of the lower horizontal transverse stay (20) from two directions, thereby moving the saddles (10,11) in relation to the base frame (4).

4. Container yoke according to claim 1, characterized in that two fixed holder-ons (33,34) are arranged on the lower horizontal transverse stay (20).

5. Container yoke according to claim 1, characterized in that a single actuator (32) is arranged at the base frame (4) to engage with and press against said holder-ons (33,34).

6. Container yoke according to claim 1, characterized in that the actuator (32) is a double-acting cylinder having a piston rod (35,36) directed in each direction.

7. Container yoke according to claim 1, characterized in that both twinlift boxes (14,15) are mechanically coupled to each other, which provides a constant distance between the twinlift boxes (14,15) and the locking members (9*a*,*b*) regardless the position of the saddle (10,11) in the direction transverse to the base frame (4).

8. Container yoke according to claim 1, characterized in that the actuators (27,28,32) are arranged under the base frame (4).

9. Container yoke according to claim 1, characterized in that the actuators (27,28,32) are hydraulic cylinders.

* * * * *